United States Patent [19]

Goodman

[11] Patent Number: 5,042,856

[45] Date of Patent: Aug. 27, 1991

[54] AUTOMATIC LOCKING MECHANISM FOR DUMPSTER LID

[76] Inventor: Lowell R. Goodman, Rte. 1, Box 79T, Chester, Md. 21619

[21] Appl. No.: 515,515

[22] Filed: Apr. 27, 1990

[51] Int. Cl.[5] ..... E05C 19/12

[52] U.S. Cl. ..... 292/259 R; 292/246; 292/237; 294/68.2; 294/68.26; 220/315

[58] Field of Search ..... 292/230, 231, 246, 259; 294/68.27, 68.2, 68.26; 220/315

[56] References Cited

U.S. PATENT DOCUMENTS

| | | | |
|---|---|---|---|
| 2,527,158 | 10/1950 | Spitalny | 220/315 |
| 4,088,071 | 5/1978 | Cruse et al. | 294/68.26 |
| 4,155,584 | 5/1979 | Pracchia | 294/68.26 |
| 4,182,530 | 1/1980 | Hodge | 294/68.26 |

*Primary Examiner*—Gary L. Smith

*Assistant Examiner*—Darnell Boucher

*Attorney, Agent, or Firm*—Longacre & White

[57] ABSTRACT

The invention is directed to an automatic locking mechanism for a dumpster container having a hinged lid. The elements of the locking mechanism comprise an L-shaped or U-shaped securing member which is attached to one or both sidewalls of the container. The securing member pivots over the lid, and is held in place by a securing mechanism. The securing mechanism fixes the L-shaped or U-shaped securing member in a position that inhibits opening of the container lid. The securing mechanism is autonatically operated by the lifting tines of a trash removal vehicle. The L-shaped or U-shaped locking member automatically swings away from the hinged lid by virtue of a counterweight during container dumping operations, and is returned to a locked configuration when the container is replaced and the lifting tines withdrawn.

4 Claims, 4 Drawing Sheets

AUTOMATIC LOCKING MECHANISM FOR DUMPSTER LID

FIELD OF THE INVENTION

The present invention relates to the field of automatic locking mechanisms for dumpster container lids. Specifically, the invention relates to a pivoting counterweighted mechanism for automatically locking and unlocking the hinged access lid for lidded dumpster containers.

BACKGROUND OF THE INVENTION

Many container lid locking mechanisms have been proposed. An example of a container lid locking system is disclosed in U.S. Pat. No. 4,534,488. While the many container lid locking mechanisms have their uses, several shortcomings have become evident with respect to efficiently and effectively locking lids on large containers. Specifically, in the field of locking container lids for trash receptacles, there are few simple locking mechanisms, and even fewer retrofit automatic mechanisms which can be applied to a broad variety of types and sizes of containers.

With the advent of mechanized trash removal, there have been created a number of large sized trash bins. These bins usually comprise a block shaped container with a hinged lid attached to one side thereof. The container further includes attachments for accommodating various forked lifting mechanisms of the trash removal vehicle. The containers are lifted by the lifting mechanism of the trash removal vehicle and pivoted in some fashion so that the hinged top of the container opens and the trash contained therein is emptied into the vehicle. The container is then returned to a position on the ground, and the hinged lid closes on top of the container.

Many of these large trash receptacles are rented from a trash removal service. These receptacles are not provided free of charge, and consequently their frequent emptying and service can become a considerable expense. This expense is increased when unauthorized users of the receptacle freely deposit trash therein. This unauthorized use necessitates a more frequent emptying of the container, and of course the unauthorized user does not contribute to the increased expense.

For the foregoing reasons, there has existed a need to create a locking mechanism for these containers which is simple and reliable, and which can be originally and retrofitted to a broad variety of containers. While many of these containers are of all metal construction, and at that very fairly heavy gauge metal, many of the newer containers are of partial plastic construction or are of all plastic construction. Hence, the ability for a user or provider of the receptacle to attach a simple welded locking structure is limited owing to the fact that not all of the parts of the container can accommodate a weld.

A device has been proposed which solves many of the shortcomings of the prior art. However, the locking device proposed cannot be automatically operated by the mere use of a trash removal vehicle to empty the container. Instead, the vehicle operator must leave the vehicle and unlock a securing chain so as to enable emptying of the container. After the dumping operation is complete, the operator must resecure the locking mechanism in the locked position. While the previously proposed device has advantages with respect to cost efficiency, the lack of automation may be considered a drawback in certain applications of the locking mechanism.

SUMMARY OF THE INVENTION

The present invention seeks to overcome the shortcomings of non automatic container locking devices. The present invention includes a release mechanism actuated by the lifting tines of the trash vehicle upon insertion of the tines into the respective lifting sleeves of the container. Further, a counter weighted locking bar pivots from the locked to unlocked positions as the container is raised and rotated over the vehicle. When the dumping operation is complete, replacing the container to a set position swings the counterweighted locking bar back into position. Subsequent removal of the vehicle tines from the container lifting sleeves automatically reengages the release mechanism with the pivoting locking bar.

These and other objects of the invention will become apparent to one of skill in this art upon the reading of the following detailed description along with the accompanying drawings which form a part thereof.

DETAILED DESCRIPTION OF THE PREFERRED EMBODIMENT

Figure 1:
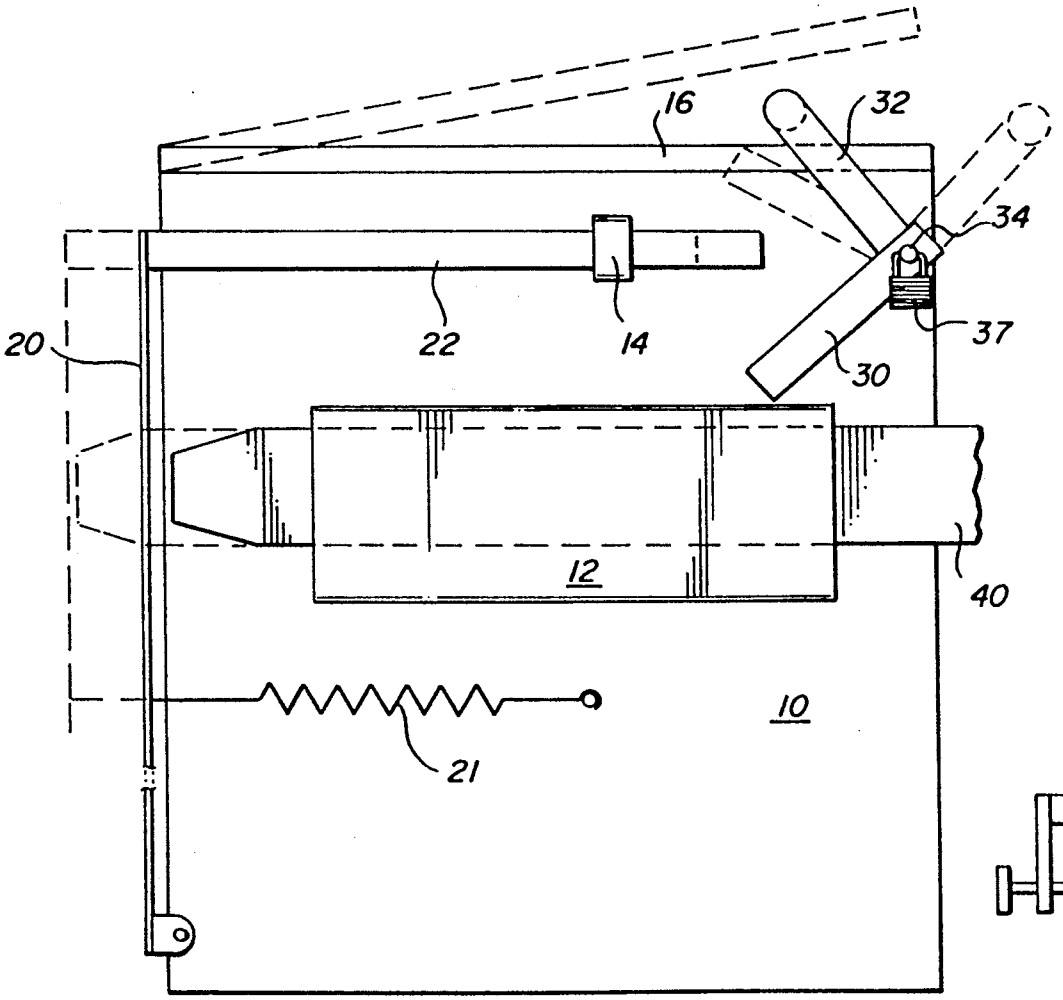
FIG. 1 is a side elevational view of an automatic locking mechanism according to the present invention, the opposite side of the container being substantially a mirror image of the side shown, with the exception that a duplicate locking assembly may or may not be desired.
Figure 8:
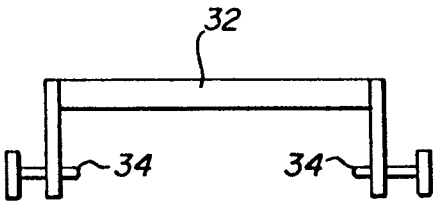
FIG. 8 shows an U-shaped locking bar.
Figure 7:
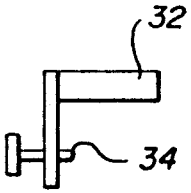
FIG. 7 shows a L-shaped locking bar.

FIG. 1 shows a container 10 equipped with a locking mechanism according to the present invention. The container 10 includes a lid 16 which hinges from a rearward portion of the container. The container also includes a pair of lifting sleeves 12 which are attached to each side of the container. To empty the container, a trash removal vehicle engages the respective sleeves 12 on each side of the container with a pair of tines 40. The vehicle then raises the container in a slowly inverting manner until the container is suspended in a substantially inverted manner over a receiving port in the top of the trash removal vehicle. As the container is inverted, the hinged lid 16 swings open and the contents of the container is allowed to empty.

The locking mechanism according to the present invention includes a pivoting locking means such as locking bar 32 pinned for pivotal motion about pin member 34 which is attached to the sidewall of container 10. The locking bar 32 can typically be L shaped or U shaped depending oh whether it is desireable or necessary for the top of the locking bar to extend across the entire top of the container. If an L shaped bar is used, a portion of the L must extend over the lid of the container to inhibit the lid from opening. If a U shaped bar is used, the bar is pinned for pivotal motion on both sides of the container, with the connecting portion of the U spanning across the lid of the container. Other shapes of locking bars may also be accommodated, so long as the pivoting described herein can be accomplished and the lid of the container can be held closed. In addition, a plurality of locking bars may also be used. The locking bars may be pivoted around one or more pin members 34 with one or more counterweights 30.

Figure 2:
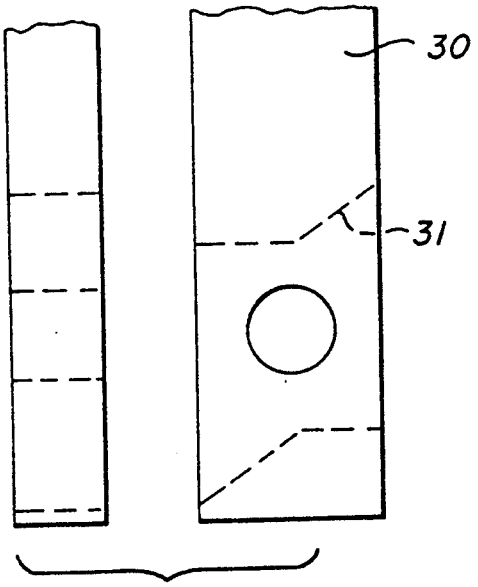
FIG. 2 is a sectional and side view of the locking bar pin detail of the present invention.
Figure 3:
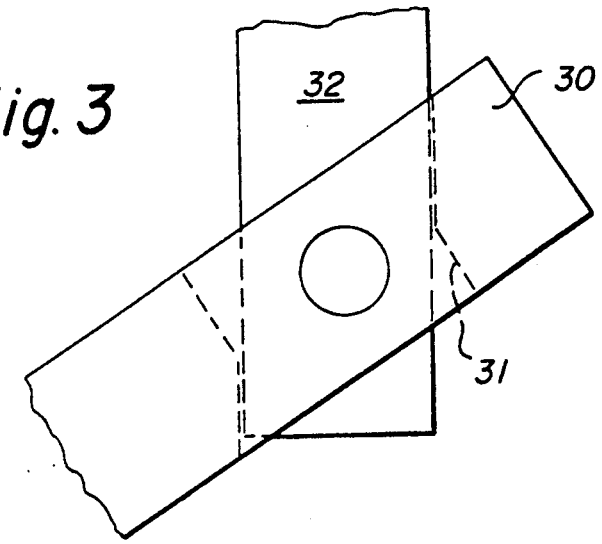
FIG. 3 is a partial sectional view of the locking bar and counterweight connection of the present invention.

The locking bar 32 is counterweighted for motion by counterweight 30 which is related to the locking bar by a double angle slot 31. The slot 31 may be gouged into the counterweight 30 or locking bar 32 as desired. As seen in more detail in FIGS. 2 and 3, the double angle slot allows the counterweight to swing more effectively during the inversion of the container so that the locking bar is assured of proper rotation. The counterweight rotates in a clockwise manner towards the locking bar during the inversion of the container and "kicks" the locking bar into rotation to free the lid of the container. When the container is reinverted, the counterweight rotates in a counter clockwise manner away from the locking bar and "kicks" the locking bar back into the locked position over the container lid. If a U shaped locking bar is used, separate counterweights on each side of the container can have differently angled counterweights with respect to the locking bar so as to have a double acting counterweight "kick" acting on the locking bar 32 to assure proper orientation of the bar as the container is emptied and replaced.

To retain the locking bar 32 in a locked configuration, the container is also equipped with an obstruction bar 22. The obstruction bar can ride in a sleeve 14 attached to the side of the container. Sleeve 14 may be of a single or varying width in the vertical direction to accommodate a range of motion of tine 40 since tine 40 is of smaller dimension than the width of sleeve 12. As shown in FIG. 1, sleeve 14 is wider in a vertical direction at an end nearest vertical support member 20. As tine 40 moves vertically within sleeve 12, consequent allowable vertical motion of the vertical support member 20 reduces stresses on the vertical support member 20 and obstruction bar 22, while keeping the end of the obstruction bar nearest the counterweight in a confined location. It is to be noted that obstruction bar 22 is mechanically decoupled from locking bar 32, counterweight 30 and pin 34, thereby eliminating mechanical stresses from the tines on the counterweight and its related parts described above during the dumping process.

The vertical support can simply hang freely from the obstruction bar, with the only support therefor being the combination of the sleeve 14 and spring 21. In one embodiment, the obstruction bar 22 and support bar 20 combination is held in an obstructing position by the heavy duty spring 21. The spring 21 is sufficiently strong, i.e., greater than approximately 150 lbs., to maintain the obstruction bar in position unless force which approximates the push of the vehicle tines 40 urges against vertical support 20 to stretch spring 21. In this way, unauthorized access to the container by moving the obstruction bar is extremely difficult.

To operate the locking mechanism, a trash removal vehicle needs to merely go through the usual container engagement and dump procedures. No special purpose equipment is needed, no padlocks require removal, no special operator training or procedures are required. An operator simply inserts the lifting tines 40 into the lifting sleeves 12 of the container, which in turn urges the vertical support 20 rearwardly, and removes obstructing bar 22 from the path of counterweight 30. The container is then lifted and pivoted to the dumping position whereby the locking bar 32 swings away from the lid 16 by urging of the counterweight acting through slot 31 against the locking bar 32.

Upon completion of the dumping operation, the container 10 is returned to a set position, during which placement of the locking bar 32 is automatically replaced over the lid 16 by action of the counterweight 30. When the trash removal vehicle retracts the tines 40 from sleeves 12, the obstruction bar 22 is automatically drawn into the obstructing position by spring 21.

Figure 4:
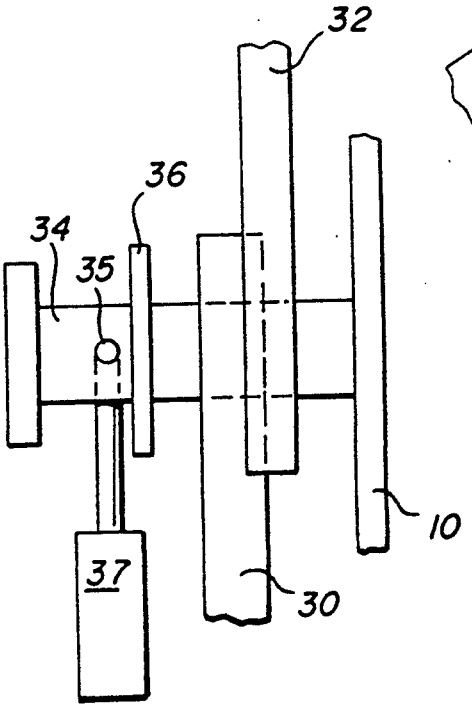
FIG. 4 is an elevational view of the locking bar and counterweight interface with a padlock in place.

FIG. 4 details a configuration of a locking detail for owner access to unlock and open the lid 16 of the container 10. The locking bar is placed onto pin 34 closest to the container, next the counterweight 30 is placed onto the pin. The locking bar and counterweight are related for rotation by double angle slot 31 which is gouged into either of the locking bar or counterweight. A washer 36 is placed on the pin so as to urge the locking bar and counter weight into engagement via slot 31. An owner operated lock 37 retains the washer 35 in necessary proximity along the pin 34 to keep the locking bar 32 and counterweight 30 working together. In the event that the owner requires access to the container 10, the lock 37 is removed, and the counterweight 30 is slid outwardly along pin 34 to disengage the locking bar 32 from counterweight 30 and allow the locking bar 32 to rotate around pin 34 and clear the lid 16 of the container 10.

The container 10 may additionally be equipped with a stop 63 for the locking bar 32 so that it does not pivot against the front side 65 of the container 10, but is instead limited to a predetermined degree of rotation towards the container front 65. Further, if a U shaped locking bar is used, the counterweight on the side of the container opposite lock 37 may exert less rotational force on the locking bar than the weight of the locking bar alone. In this way, the locking bar will not be rotated to a closed position during owner access to the container.

Figure 5:
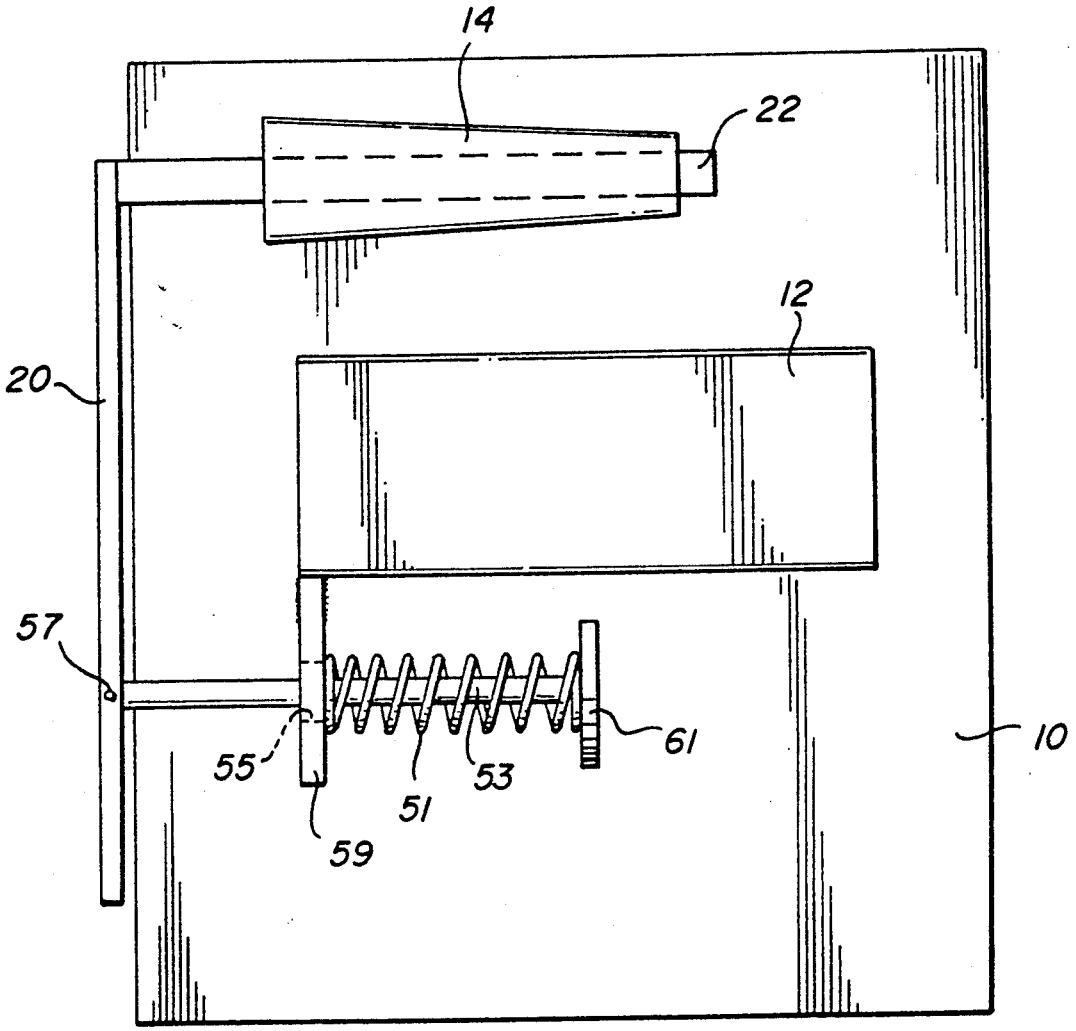
FIG. 5 is an alternative embodiment of the spring mechanism.
Figure 6:
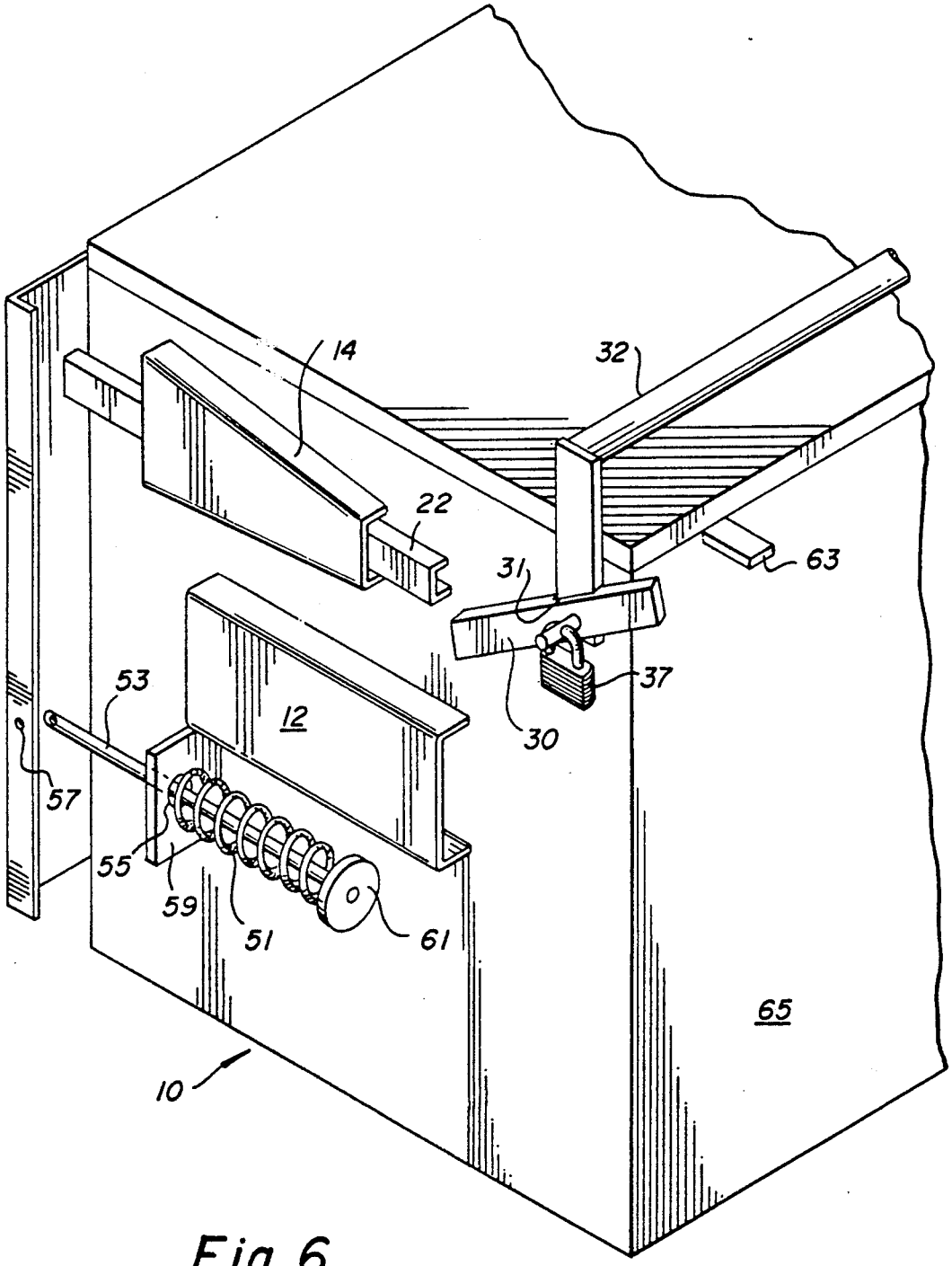
FIG. 6 is a perspective view of a container having an automatic locking mechanism according to the invention.

FIGS. 5 and 6 illustrate an alternative embodiment of the present invention with respect to the spring used to resist motion of the obstruction bar 22. A rod 53 is attached to support bar 20 and includes an end plate 61 and cooperating spring 51. The end of the spring 51 opposite end plate 61 is held in place against a guide plate 59 attached to a sidewall of the container 10. The guide plate 59 includes a hole therein for supporting and guiding rod 53 as it is urged forward and back by the tines of a truck 40.

The locking assembly, and all of the parts thereof, is contemplated as being of all metal construction for use with all metal dumpster containers. However, a variety of stock materials can be used to create the elements of the locking assembly depending on the container to which the mechanism is to be fitted.

In an alternative embodiment, the counterweight may also be hollow and contain a translating weight therein, i.e., lead shot, to provide the "kick" necessary to urge the locking bar to rotate. This alternative counterweight would substantially eliminate the need for the two angle slot 31 between the locking bar and counterweight.

Further variations of the present invention will occur to those skilled in the art, and the claims listed below are not in anyway intended to limit the scope of this invention.

I claim:

1. An automatic pivoting locking mechanism for a dumpster container having a hinging lid, said locking mechanism comprising:

a U shaped locking bar pivotally attached to opposite sidewalls of the container by the extended portions of the legs of the U shape so that said bar connecting between the respective legs pivots over said hinging lid of said container, said U shaped locking bar being pivotal between a position which inhibits the opening of said lid, and a second position which does not inhibit the opening of said lid;

counterweight means connected to said U shaped locking bar for pivotal rotation therewith;

obstruction bar means for inhibiting the pivotal motion of said locking bar between said positions, said obstruction bar means being biased into a first position which inhibits the pivotal motion of said locking bar means; whereby, when said obstruction bar means is urged to a second position thereof, and said container is translated into a substantially inverted dumping position, said counterweight mean urges said U shaped locking bar to pivot to said second position which does not inhibit the opening of said lid.

2. A locking mechanism as in claim 1, further comprising:

removable locking means for selectively connecting and disconnecting said counterweight and said locking bar.

3. An automatic pivoting locking mechanism for a dumpster container having a front, back and sidewalls and a hinging lid, said locking mechanism comprising:

an L shaped locking bar pivotally attached to one of said sidewalls and adjacent said front wall of the container and having one leg of the L shape pivot over said hinging lid of said container, said L shaped locking bar being pivotal between a position which inhibits the opening of said lid, and a second position which does not inhibit the opening of said lid;

counterweight means connected to said L shaped locking bar for pivotal rotation therewith;

obstruction bar means mounted to at least one of said sidewalls and extending backward towards said backwall for inhibiting the pivotal motion of said locking bar between said positions, said obstruction bar means being biased into a first position which inhibits the pivotal motion of aid locking bar means; whereby, when said obstruction bar means is urged to a second position thereof, and said container is translated into a substantially inverted dumping position, gravitational force causes said counterweight means to pivot thereby urging said L shaped locking bar to pivot to said second position which does not inhibit the opening of said lid.

4. A locking assembly as in claim 3, further comprising:

removable locking means for selectively connecting and disconnecting said locking bar from said counterweight.

* * * * *